United States Patent [19]

Nawrath

[11] 4,329,922

[45] May 18, 1982

[54] PRINTING MACHINE CYLINDER SHAFT ATTACHMENT ARRANGEMENT

[75] Inventor: Nikolaus Nawrath, Igenhausen, Fed. Rep. of Germany

[73] Assignee: M.A.N.-ROLAND Druckmaschinen Aktiengesellschaft, Offenbach am Main, Fed. Rep. of Germany

[21] Appl. No.: 231,161

[22] Filed: Feb. 3, 1981

[30] Foreign Application Priority Data

Feb. 9, 1980 [DE] Fed. Rep. of Germany ..... 3004921

[51] Int. Cl.[3] ..... B41F 13/24

[52] U.S. Cl. ..... 101/248

[58] Field of Search ..... 101/212, 216, 248

[56] References Cited

U.S. PATENT DOCUMENTS

| | | | |
|---|---|---|---|
| 2,775,935 | 1/1957 | Reinartz et al. | 101/248 |
| 4,207,815 | 6/1980 | Watanabe | 101/248 |
| 4,214,528 | 7/1980 | Mirow | 101/248 |

FOREIGN PATENT DOCUMENTS

| | | | |
|---|---|---|---|
| 413079 | 5/1925 | Fed. Rep. of Germany | 101/212 |
| 1047213 | 12/1958 | Fed. Rep. of Germany | 101/216 |
| 1558031 | 3/1968 | France | 101/216 |
| 421145 | 8/1924 | Switzerland | 101/248 |

*Primary Examiner*—E. H. Eickholt

*Attorney, Agent, or Firm*—Frishauf, Holtz, Goodman & Woodward

[57] ABSTRACT

To provide for self-alignment in axial as well as circumferential direction of bearing cups holding a fixed shaft of a cylinder, in which the cups are selectively rotatably adjustable and held by axial bolts extending into bearing blocks, the shaft ends or stubs (6, 7) have cross pins (17, 18) extending transversely thereto. The bearing cups (6, 7) are half-cylindrical and, upon positioning of one of the cups, while leaving the other one to be rotatable, engagement of the respective cross pin with the positioned cup will permit alignment of through-bores extending at right angles to the axis of the shaft through the shaft and into the bearing cup for attachment by an attachment bolt (15, 16). One of the bearings is fixed; the other bearing permits axial excursion to compensate for thermal expansion of the cylinder by interposition of a spring, for example a cup spring (13) surrounding a collar formed on the attachment bolt (12), tightening of the attachment bolt biassing the spring while permitting rotation of the respective bearing cup (9) and self-alignment thereof by engagement with the cross pin (18) of the half-cylindrical portion. Preferably, the cross pins simultaneously prevent loss of the attachment bolts (15, 16) by interfering with the clearance diameter through the hole in the shaft, thus preventing unintended removal of the bolts. Rotatable sleeves can be fitted over the attachment arrangement to prevent contamination.

10 Claims, 3 Drawing Figures

FR
14
22
20
9
13
12
16
7
III
I
18
III
5
1
3

2
4
15
17
8
6
10
19
11
21
FL 18
7
9
16
20

PRINTING MACHINE CYLINDER SHAFT ATTACHMENT ARRANGEMENT

The present invention relates to printing machines, and more particularly to the arrangement to attach a shaft of a cylinder, for example an inking cylinder or inking roller in the machine, in which the respective roller or cylinder has a fixed shaft on which a rotatable sleeve or outer cylinder is mounted.

BACKGROUND

It is frequently necessary to mount various types of rollers or cylinders in printing machines in such a manner that they can be easily disassembled from the machine. Typical shafts and cylinders or rollers of this type are rollers and cylinders used in inking fountain systems, spindles, wetting fountain system rollers and cylinders, and the like. The central shaft is fixed and does not rotate. The central shaft carries two or more bearings axially distributed about its length, and an outer sleeve or outer cylinder is rotatably mounted on the bearings. One system for mounting such cylinders or sleeves is described in German Pat. No. 413,079 which describes a mounting arrangement for ink rollers, spindles or the like for use in printing machines, in which a sleeve and a pin axially fit into each other. A ring portion is mounted on the sleeve, and the pin or stub has a ring flange. By relative rotation of the one or the other portion, the two parts are locked together and form a closed bearing for the stub or pin. This arrangement permits simple assembly of the ink roller into the printing machine. The ink roller is made of a unitary cylindrical body which rotates in the bearing. Circumferential attachment of the stub or pin of the ink roller in the bearing is not necessary or, even, may be undesirable for operating reasons. Such a roller, thus, has a rotating shaft. Use of such a bearing with a fixed shaft on which a sleeve is rotatably located requires, however, attachment of the ends of the shaft or stub ends to fixed matching holding elements on the machine since the bearings are already mounted on the shaft.

THE INVENTION

It is an object to provide an arrangement for attachment of projecting stubs from a shaft supporting a rotatable sleeve which can be easily assembled in a printing machine and which provides for automatic self-alignment of the shaft in the machine; and, preferably, is so arranged that the attachment can be securely fastened after having been self-aligned, while still permitting relative expansion of the sleeve and the shaft with respect to the machine, for example to compensate for heating under operating conditions.

Briefly, the side walls of the machine carry cylindrical half shells, that is, elements which are diametrically cut away so as to form at least in part open troughs in which the shaft stubs or shaft extensions of the cylinder can be placed. The trough-like shaft portions are rotatably secured to the side walls. After aligning one of them for positioning of the shaft therein, the other one can be self-aligned. The stubs from the cylinder shaft are formed with transversely extending pins which come to lie on the open side surfaces of the trough-like cut-away half cylinders. Thus, transversely extending attachment holes, through which attachment bolts can be passed extending diametrically through the shaft and into the half cylinders will automatically align. The transversely extending pin on the stub shaft which is placed on the fixed trough-like extensions will align the shaft with the trough-like extensions for positioning of the shaft. The other end of the shaft then positions the other stub shaft by engagement of its transversely extending pin with the other half cylinder which can be rotated for positioning and, once positioned, tightened in place.

The arrangement permits attaching the shaft in the machine without introducing any stresses on the shaft which might interfere with free running of the bearings journaling the rotatable sleeve, and hence the free running of the sleeve. By forming one of the clamping bolts which clamp the half-cylinders in position so as to be slightly axially movable, for example under stress of a bias spring, axial expansion due to thermal effects can be compensated. A permanent axial pressure is provided by the resilient bias, for example by a cup spring.

The arrangement of the transverse locating pins permits accurate axial alignment of the attachment holes which, additionally, insures that the attachment holes can always be inserted from the top so that they cannot fall out, for example due to inadvertent loosening, and fall into the machine and damage machine components. Preferably, the cut-away portions of the half-sleeve merge with the full portion of the sleeve by inclined surfaces to facilite insertion and positioning of the roller or cylinder in the machine.

DRAWINGS

Figure 2:
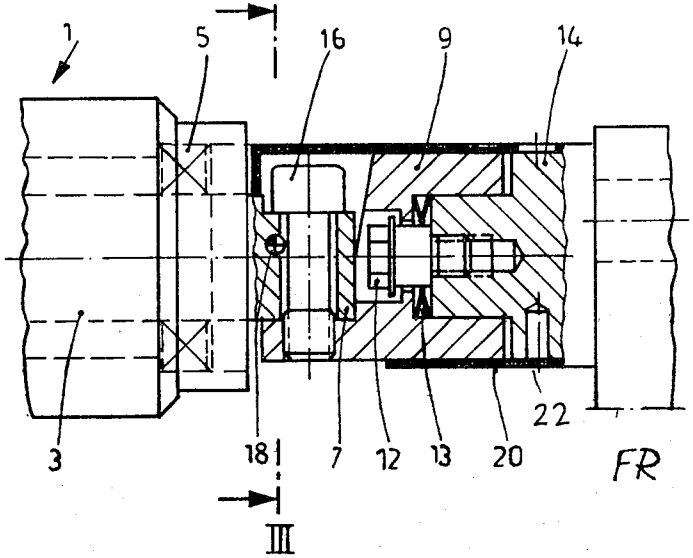
FIG. 2 is a view similar to FIG. 1 and illustrating the right side, partly in section, in which the attachment arrangement permits for thermal expansion.
Figure 1:
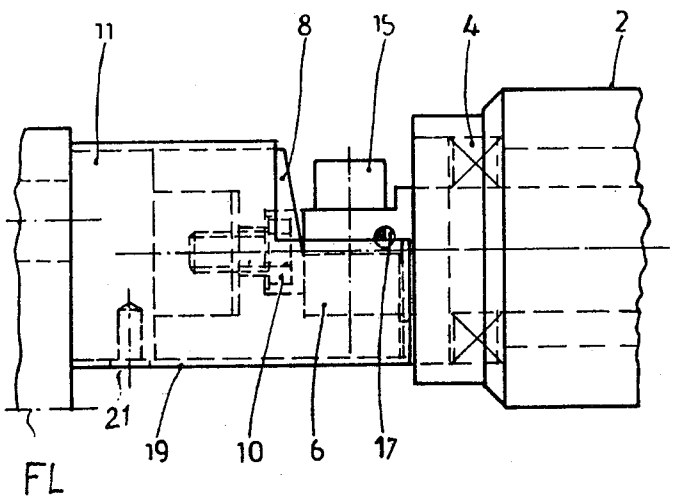
FIG. 1 is side view of a fixed attachment arrangement and illustrating, for example, the left side of an inking cylinder secured to the machine.

FIGS. 1 and 1, taken together, illustrate the complete attachment arrangement for a shaft, although the embodiment of FIG. 2 can also be used for the left side of attachment of a roller or cylinder. The invention will be described in connection with a freely running inking roller 1 which has a sleeve 2 rotatably positioned on a fixed shaft 3. Shaft 3 carries bearings 4, 5 at its axial ends in which the outer sleeve 2 of the inking roller 1 is journaled for rotation about shaft 3.

The left stub 6 of the shaft 3 (FIG. 1) and the right stub 7 (FIG. 2) of the shaft 3 each are retained in a respective bearing cup 8, 9. The bearing cups 8, 9 are tubular elements with cross walls. Screws 10, 12 pass through the cross walls into respective bearing blocks 11, 14. The screw 10, passing through the cross wall of bearing cup 8, is directly connected to the block 11.

The screw 12 passing through the cross wall of the bearing cup 9 is formed with a collar slightly larger than the threaded portion of the screw 12 on which a cup spring 13 is positioned. The collar screw 12 secures the cross wall of cup 9 in the bearing block 14. The cup spring 13, seated on the collar portion of the screw 12, permits axial excursion of the cup element 9 against the tension of the spring 13. Thus, the bearing on one side—see FIG. 1—is axially fixed; the bearing on the right side—see FIG. 2—is axially movable. The axial play is determined by the length of the collar of the screw 12 and by the tension of the cup spring 13. The bearing blocks 11, 14 are eccentrically mounted in suitable openings of the left frame FL and on the right frame FR, respectively, in order to permit contacting the outer circumference of the cylinder 1 with a parallel cylinder (not shown) and adjust the contact pressure, as well known.

The inwardly directed end portions of the bearing cups 8, 9 are cut off to the center thereof, to be trough-shaped, forming holding cups for the stubs 6, 7 of the shaft 3. Preferably, the walls leading to the cup-shaped cut-away half-cylindrical portions of the bearing cups 8, 9 are inclined, as clearly seen in FIGS. 1 and 2, which substantially facilites insertion of the roller or cylinder 1 which, for example, may be an inking cylinder.

The stubs 6, 7 of shaft 3 are secured in the respective bearing cups 8, 9 by screws 15, 16 passing perpendicularly through the shaft 3 and into the respective bearing cups—see FIG. 2.

In accordance with the present invention, the stubs 6, 7 are formed with or have inserted therein locating pins 17, 18 fitting transversely through the stub shafts. The pins 17,18 extend transversely to the axis of the shft, preferably at a right angle, and also at a right angle with respect to screws 15, 16. They project at both sides from the shaft 3. As best seen in FIG. 2, the locating pins 17, 18 are positioned immediately adjacent the through-hole for the bolts 15, 16. The bolts 15, 16 are turned down at the portion between the thread and the head, and the pins 17, 18 pass in the space between the head and the threaded portion of the screw—see FIG. 2. The clearance of the hole through the shaft is thus reduced in the region of the position of the respective pins 17, 18, which prevents loss of the screws 15, 16 from the stubs 6, 7, and hence prevents loss of the screws upon installation or in use, so that the screws cannot fall into the printing machine and possibly cause damage therein. The collar on the attachment screw 12, in combination with the cup spring 13 thereon, permits adjustment of the axial play of the bearing cup 9 on the holding screw 12.

Assembly: Screw 10 as well as screw 12 are loosened, so that the bearing cups 8, 9, due to their tubular configuration, can rotate with respect to bearing blocks 11, 14. The cups 8, 9 fit over projecting cylindrical portions formed on the respective bearing blocks 11, 14, as best seen in FIG. 2.

Figure 3:
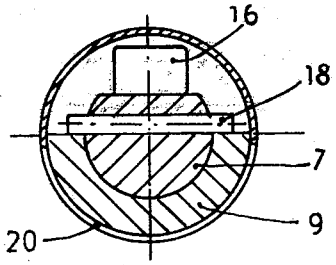
FIG. 3 is a transverse section taken along line III—III of FIG. 2.

One of the bearing cups, preferably, the one which has the axially fixed bearing, that is, bearing cup 8 (FIG. 1), is rotated into a position suitable for insertion of the shaft therein, that is, providing easy access. The bolt 10 then is tightened, so that the cup 8 is fixed in position. Bolt 12 is tightened to a degree commensurate with adjustment of the spring pressure of spring 13. The cup 9 still is rotatable with respect to the block 14, however. Upon insertion of the cylinder 1, the transverse locating pins 13 will fit on the cut-off surface on the circumferentially adjusted and axially positioned bearing cup 8. The shaft 3 of the cylinder 1 thus will be rotated by engagement of the pin on the circumference of the bearing cup to a desired circumferential position—see FIG. 3, which illustrates the position of the bearing cup 9 at the right side. In this position, the hole through the stub 6 of the shaft 3 will be in alignment with the receiving hole in the bearing cup 8, and bolt 15, previously retained in the hole through the shaft by the presence of the locating pin 17 can be tightened into the hole. Since the bearing cup 9 is rotatable with respect to the block 14, the bering cup 9 will self-align by pressure of the cross pin 18 against the cut-away surfaces of the bearing cup 9—see FIG. 3—thus also aligning the threaded hole in the cup 9 with the hole through the shaft stub 7, permitting tightening of screw 16.

The inking cylinder 1 now is in the desired position in the bearing cups 8, 9. The cup spring 13 presses the inking roller continuously towards the left, that is, towards the bearing cup 8. Both screws 15, 16 can then be tightened to a suitable torque. The spring 13 permits slight axial excursion of the bearing cup 9 with respect to the block 14, for example to accept expansion of the cylinder 1 due to heating. This permitted excursion of the shaft relieves any stresses placed on the shaft due to heating, and thus prevents distortion thereof, and hence misalignment of the bearings 4, 5 which hold the sleeve 2 of the cylinder or roller 1.

Contamination and dirt are excluded from the bearing by providing protective sleeves 19, 20. Sleeve 19 (FIG. 1) is a tubular portion which surrounds the bearing cup 8, the bearing block 11, screw 15, and the locating cross pin 17 as well as the stub shaft 6. Likewise, protective sleeve 20 is provided at the right side of the assembly (see FIG. 2) which surrounds the bearing cup 9, screw 16, locating cross pin 18, bearing block 14, and the right shaft stub 7. The sleeves 19, 20 are formed with transverse diametrical cuts which can be aligned with the open cuts which form the trough portions of the bearing cups 8, 9. By rotating the sleeves 19, 20 to place the solid portion thereof over the cut-away portion—as shown in FIG. 2—the protective sleeve will close off the open trough portion and thus prevent contamination or dirt from reaching the attachment arrangement, or collecting in the open trough. After assembly of the cylinder 1, therefore, the sleeves 19, 20 are rotated by 180°, thereby obtaining precise cover and protection of the attachment arrangement. The sleeves 19, 20 can then be secured in position by set screws 21, 22 passing through a suitable opening, or by backing off previously inserted set screws to provide a clamping fit.

Various changes and modifications may be made; for example, the cup spring 13 can be replaced by other types of springs or other types of resilient elements, for example a rubber ring, plastic compression bushing or the like.

I claim:

1. In a printing machine, a cylinder-shaft attachment arrangement having a non-rotatable shaft (3);

a cylindrical shell (2);

axially staggered bearings (4, 5) between the shaft and the shell and journaling the shell on the shaft;

and means secured to the shaft to attach the shaft to printing machine frame members (FL, FR)

comprising, in accordance with the invention, two bearing cups (8, 9) facing each other;

means (10, 11; 12, 14) rotatably adjustably attaching said bearing cups to respective frame members, said bearing cups having half-cylindrical end portions at the sides facing each other;

through-bores extending at right angles through the respective end portions or stubs of the shaft (3) and into the respective bearing cups (6, 7);

attachment bolts (15, 16) passing through said bores in the end portions or stubs of the shaft and into the bearing cups to attach the shaft ends to the bearing cups;

and positioning pins (17, 18) extending transversely with respect to the shaft, one at each end, and fitting on the respective half-cylindrical end portions of the bearing blocks for aligning the rotatably adjustable bearing cups so that the through-bores in the shaft ends and in the bearing cups will self-align for passing the attachment bolts therethrough.

2. Arrangement according to claim 1, wherein the bearing cups are tubular cylindrical elements having facing end portions cut away to form half-cylindrical trough-shaped cups;

and wherein the surfaces between the full-cylindrical and half-cylindrical portions are inclined with respect to the axis of the cyliner to facilitate insertion of the end portions or stubs (6, 7) of the shaft (3).

3. Arrangement according to claim 1, wherein the means attaching said bearing cup to the machine frame members (FL, FR) comprise respective bearing blocks having projecting portions interfitting with the bearing cups;

and axially extending attachment bolts (10, 12) securing the bearing cups (8, 9) on the blocks (11, 14) while permitting relative rotation, said blocks (11,14) being eccentrically secured to the respective machine frame member.

4. Arrangement according to claim 1 or 3, wherein said attaching means comprises an axially extending bolt (10) to provide for axially fixed position and attachment of said bearing cup to a frame member (FR) of the machine;

a threaded bolt (12) having a collar thereon of a diameter greater than the threaded portion of the bolt and axially passing through the other bearing cup for attachment of the other bearing cup to the other frame member (FR) of the machine;

and elastic means interposed between the bearing cup and the frame member of the machine positioned on said collar, permitting axially restrained movement of the bearing cup with respect to said frame member, rotary position of said bearing cup being determined by the respective positioning pin (18) engaging the bearing cup (9).

5. Arrangement according to claim 4, wherein the elastic element (13) comprises a cup spring.

6. Arrangement according to claim 1, wherein at least one of the means attaching said bearing cup to a respective machine frame member includes a connecting element permitting axial play or movement of the respective bearing cup with respect to the respective frame member, and elastic means (13) biassing the bearing cup with respect to the frame member in a predetermined position while permitting axial deflection.

7. Arrangement according to claim 6, wherein said bearing cups comprise tubular, cylindrical elements having respective end portions diametrically removed to form trough-shaped receiving cups for the end portions or stubs (6, 7) of the shaft (3);

a cross wall formed in each of sid cups;

and attachment screws (10, 12) passing axially through said cross wall towards the frame members of the machine (FL, FR).

8. Arrangement according to claim 1, wherein the attachment bolts (15, 16) have a head portion, a threaded end portion, and an intermediate body portion of lesser diameter than the head portion and the threaded end portion;

and wherein said positioning pins comprise transversely extending pins passing through the shaft and in the region of the body portion of reduced diameter, and projecting towards said body portion to prevent removal of the bolt from the through-bore in the end portion (6, 7) of the shaft (3).

9. Arrangement according to claim 1 or 6 or 7 or 8, further including rotatable protective sleeves (19, 20) surrounding the half-cylindrical end portions, the attachment bolts (15, 16), and the positioning pins (17, 18), and extending towrds the cylindrical shell (2) to protect the end portions or stubs of the shaft, the bolts and the cross pins against contamination.

10. Arrangement according to claim 9, wherein said sleeves have half-cylindrical end portions to permit rotation of said protective sleeves to match the half-cylindrical end portions of the bearing cups for insertion of a cylinder and shaft (2, 3) combination, and permitting rotation to closed, protected position;

and locking means (21, 22) locking said protective sleeves in protecting position.

* * * * *